US005960497A

United States Patent [19]

Castellino et al.

[11] Patent Number: 5,960,497

[45] Date of Patent: Oct. 5, 1999

[54] PRESSURE RELIEVING PAD WITH GRADUATED PILLARS

[75] Inventors: Robin L. Castellino, Louisville; Gregory S. Marino, Westminster; Dustin E. Gabel, Boulder, all of Colo.

[73] Assignee: KCI-RIK Acquisition, Corp., San Antonio, Tex.

[21] Appl. No.: 08/916,544

[22] Filed: Aug. 22, 1997

[51] Int. Cl.[6] ..... A47C 27/14; A47C 27/18; A47C 27/057

[52] U.S. Cl. ..... 5/730; 5/727; 5/665

[58] Field of Search ..... 5/730, 724, 729, 5/726, 727, 665

[56] References Cited

U.S. PATENT DOCUMENTS

| | | | |
|---|---|---|---|
| D. 336,400 | 6/1993 | Mitchell et al. | D6/596 |
| 3,974,532 | 8/1976 | Ecchuya | 5/724 |
| 4,110,881 | 9/1978 | Thompson | 5/730 |
| 4,483,029 | 11/1984 | Paul | 5/689 |
| 4,485,505 | 12/1984 | Paul . | |
| 4,509,219 | 4/1985 | Yagi . | |
| 4,620,337 | 11/1986 | Williams et al. | 5/730 |
| 4,768,251 | 9/1988 | Baskent | 5/730 |
| 4,847,933 | 7/1989 | Bedford . | |
| 4,862,538 | 9/1989 | Spann et al. . | |
| 4,866,800 | 9/1989 | Bedford . | |
| 4,901,387 | 2/1990 | Luke | 5/730 |
| 4,980,940 | 1/1991 | Isshiki | 5/724 |
| 5,025,519 | 6/1991 | Spann et al. | 5/730 |
| 5,101,527 | 4/1992 | Wadsworth, III et al. | 5/730 |
| 5,111,542 | 5/1992 | Farley | 5/730 |
| 5,153,956 | 10/1992 | Nold | 5/944 |
| 5,201,780 | 4/1993 | Dinsmoor, III et al. | 5/676 |
| 5,255,404 | 10/1993 | Dinsmoor, III et al. | 5/676 |
| 5,303,436 | 4/1994 | Dinsmoor, III et al. | 5/676 |
| 5,327,597 | 7/1994 | Rothbard . | |
| 5,353,455 | 10/1994 | Loving et al. | 5/730 |
| 5,511,260 | 4/1996 | Dinsmoor, III et al. | 5/676 |

FOREIGN PATENT DOCUMENTS 2225229 5/1990 United Kingdom .

*Primary Examiner*—Alexander Grosz
*Attorney, Agent, or Firm*—W. Scott Carson

[57] ABSTRACT

A pressure relieving pad with graduated pillars to effectively reduce the development of decubitus ulcers. The pad is preferably made of foam to keep the manufacturing costs down and includes a first plurality of large pillars or columns. A second plurality of smaller pillars or columns is then positioned atop each of the larger pillars forming a progression or graduation of pillars. Adjacent larger pillars are preferably attached to one another at their bases to form an underlying, support platform or level for the pad. In operation, the weight or force of the patient using the pad is progressively transferred from the small pillars on top downwardly through the larger pillars to the underlying support platform or level.

26 Claims, 7 Drawing Sheets

PRESSURE RELIEVING PAD WITH GRADUATED PILLARS

BACKGROUND OF THE INVENTION

1. Field of the Invention

This invention relates to the field of mattress and other cushion pads primarily intended for medical use to prevent or reduce the development of decubitus ulcers in patients using the pads.

2. Discussion of the Background

Decubitus ulcers, commonly referred to as bed or pressure sores, are a major health concern for patients that become bed or chair bound for prolonged periods of time. They are also frequent complications for burn victims and tall, thin patients and other patients with particularly bony protuberances. The ulcers generally develop at such bony protuberances as well as other relatively bony areas of the patient's body including the trochanteric (hip) area, scapula (shoulder blade) area, spinal area, and coccyx (tailbone) area where relatively little flesh is present and blood circulation is often poor. Factors contributing to the development of the decubitus ulcers are numerous including the general overall condition of the patient's skin and underlying tissue. Forces generated on the patient's body by the mattress pad or other support are also critical.

Examples of a popular mattress pad design that effectively reduces the development of decubitus ulcers using a pillared or columned layer of foam are disclosed in commonly owned U.S. Pat. Nos. 5,201,780, 5,225,404, 5,303,436, and 5,511,260. The basic approach of these patents involves placing a fluid bladder layer over a layer of foam which has had pillars or columns cut into it. While this approach is very effective, it is also relatively expensive as are similarly effective designs such as the fluidized bead bed of U.S. Pat. No. 4,483,029. Presently, many medical insurers will not routinely qualify patients to use such costly but effective devices unless they are at extreme risk of developing decubitus ulcers or have already developed them. Most patients at risk or who even have minor, existing ulcers are currently directed by their insurance carriers to use lower cost devices such as pillared or convoluted foam pads. These pads are commonly categorized as preventative products. They usually provide some reduction in pressure (i.e., as compared to a standard mattress) but cannot approach the pressure relief or patient outcome of the high-end products.

Many patients who are placed on the low-end, preventative products develop multiple and/or severe decubitus ulcers. These patients are then placed on the higher-end products until healed. Once healed, most insurance carrier guidelines currently force them back onto a low-end product where they face a high likelihood of repeated breakdown.

Consequently, there is a significant need for a better performing product to help close the gap between the high and low-end devices. The primary purpose of the present invention is thus to create a product that provides a greater degree of pressure relief than currently exists in the low-end products without incurring the high manufacturing cost of the high-end products. This invention can also be used in combination with the high-end, more expensive technologies to create an intermediate product (e.g., a mattress pad with a high-end center section of fluid bladders and with head and foot sections using the graduated pillar design of the present invention).

SUMMARY OF THE INVENTION

This invention involves a pressure relieving pad with graduated pillars to effectively reduce the development of decubitus ulcers. The pad is preferably made of foam to keep the manufacturing costs down and includes a first plurality of large pillars or columns. A second plurality of smaller pillars or columns is then positioned atop each of the larger pillars forming a progression or graduation of pillars. Adjacent larger pillars are preferably attached to one another at their bases to form an underlying, support platform or level for the pad. In operation, the weight or force of the patient using the pad is progressively transferred from the small pillars on top downwardly through the larger pillars to the underlying support platform or level.

The smaller pillars or columns on top conform to the small bony protrusions (e.g., an elbow) and other variations in the patient's body. These smaller pillars exert less pressure on the patient's skin at these critical locations (micro-conformation) than if the patient were supported directly on the underlying, larger pillar. Additionally, the smaller pillars have some ability to move sideways with the patient's body, reducing shear forces on the patient's skin. The underlying, larger pillars or columns then allow the pad to achieve good pressure reduction in larger, heavier parts of the body (e.g., hips, buttocks) that require deep immersion (macro-confirmation) for proper support. The smaller pillars have relatively low spring constants compared to the underlying, larger pillar. In this manner, the graduated pillar design offers not only a continuum of pillar sizes for micro and macro-confirmations but also a continuum of spring constants at different depths of immersion.

DETAILED DESCRIPTION OF THE PREFERRED EMBODIMENTS

Figure 1:
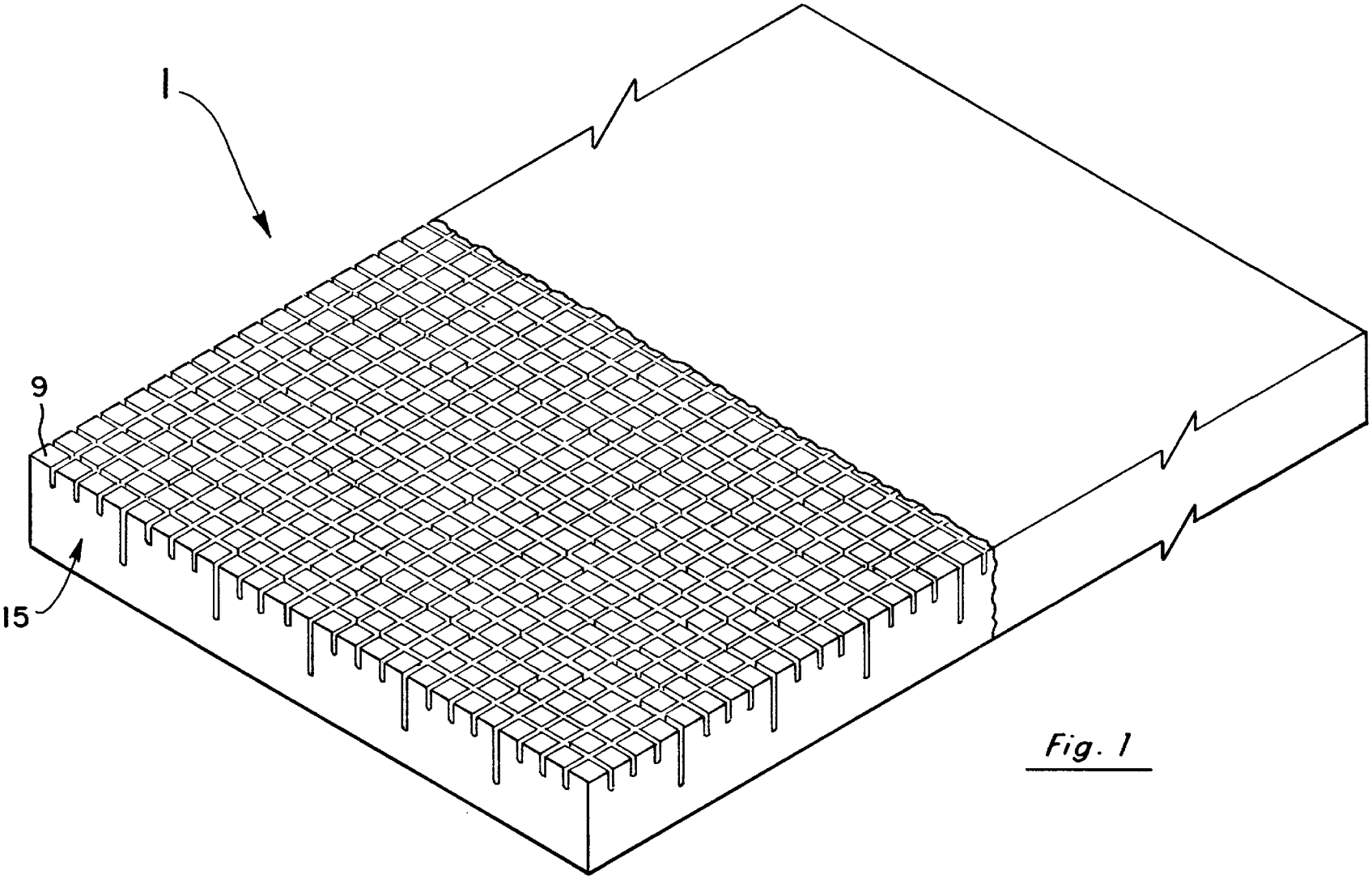
FIG. 1 is a perspective view of the pad of the present invention adapted for use as a full length, mattress pad.
Figures 2, 3:
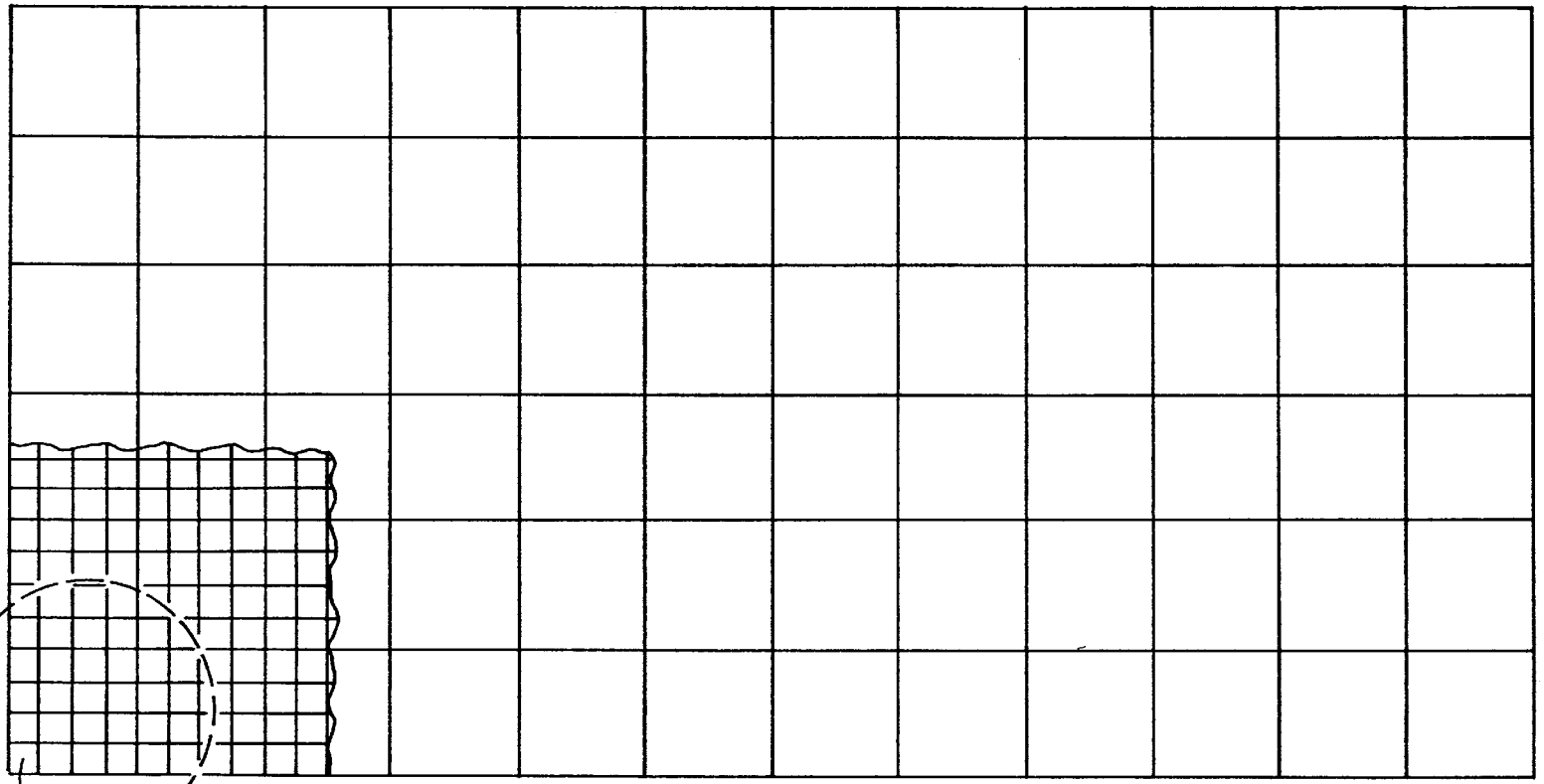
FIG. 2 is a plan view of the pad of FIG. 1.
FIG. 3 is an enlarged, plan view of the corner portion of the pad within the encircled area of FIG. 2.
Figure 3:
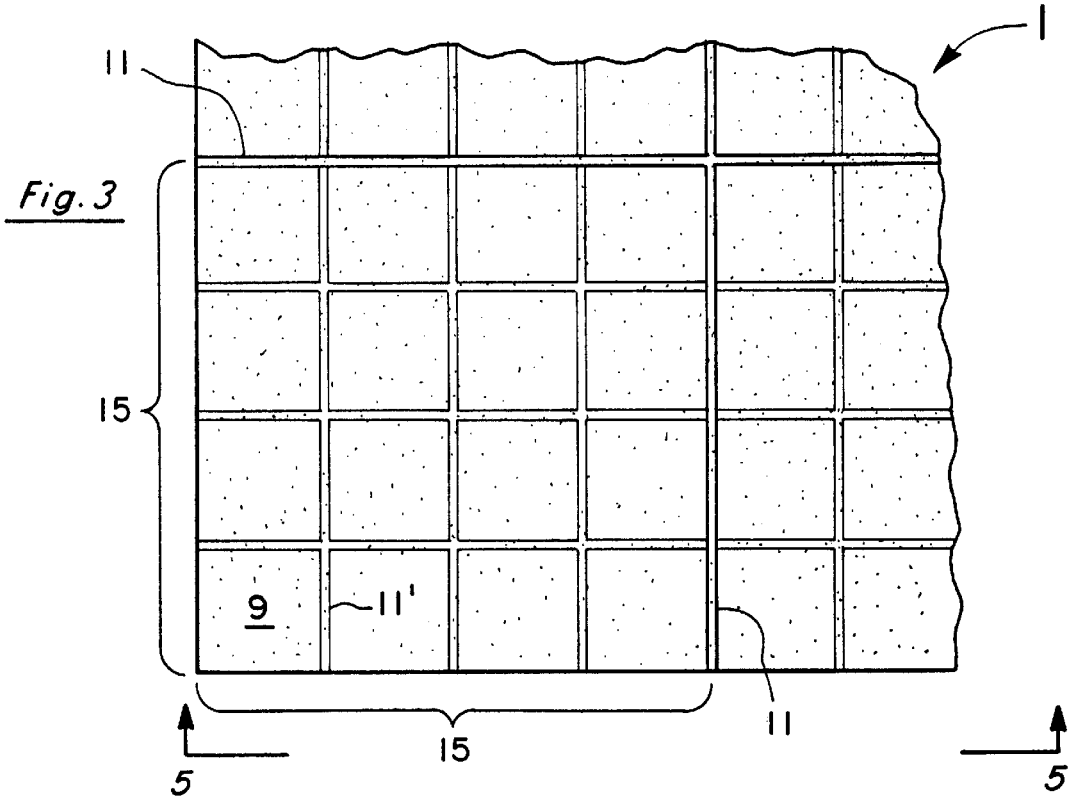
Figure 4:
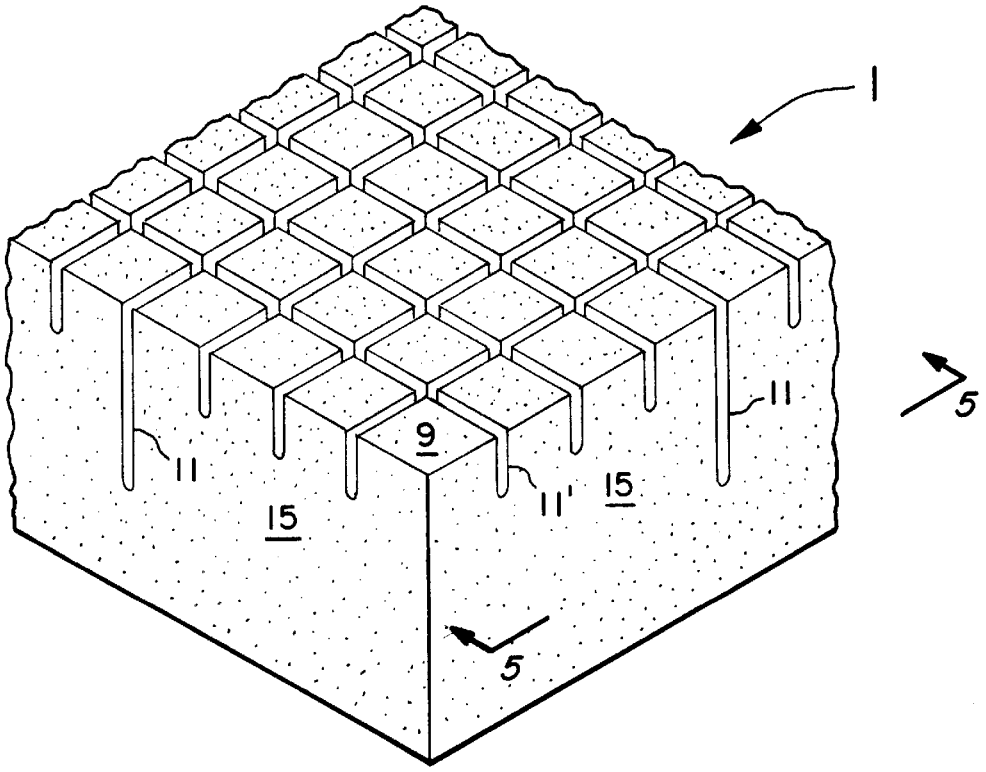
FIG. 4 is a perspective view of the enlarged, corner portion of the pad of FIG. 3.
Figure 5:
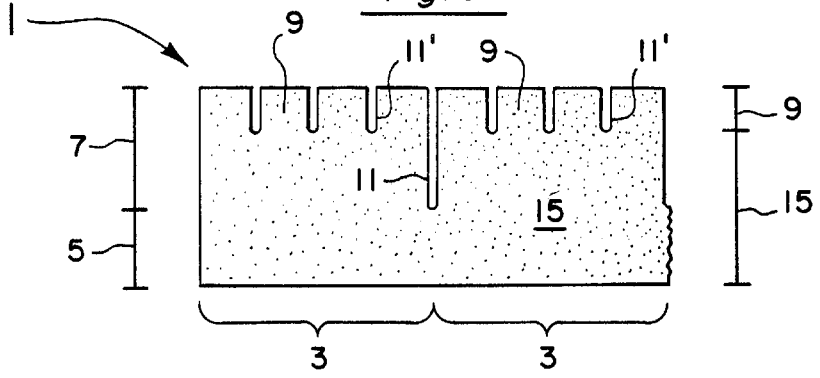
FIG. 5 is a view taken along line 5—5 of FIGS. 3 and 4.

FIGS. 1 and 2 illustrate the graduated pillar or column concept of the present invention adapted for use in a full length, mattress pad 1. FIGS. 3–5 are enlarged views of various features of the pad 1. As shown in FIGS. 1–5, the mattress pad 1 is preferably made of foam that has been cut or otherwise formed to include spring members 3 (see FIG. 5). Each of the two spring members 3 illustrated in FIG. 5 has a base portion 5 and a top portion 7. The base portions 5 of the immediately adjacent spring members 3 are attached to one another (e.g., preferably cut from the same, continuous piece of foam). Each top portion 7 positioned above each base portion 5 has a plurality of upstanding, resilient, spring elements 9 cut or otherwise formed in it. As illustrated, the top portions 7 of the spring members 3 are separated and spaced from each other by cuts or slits 11. Similarly, the tops or upper sections of the spring elements 9 are separated and spaced from one another by cuts 11'. As shown, the attached base portions 5 of the spring members 3 form an underlying, resilient support platform or level supporting the top portions 7 positioned above them. The weight or force of the patient (see FIG. 6) is then transferred from the upper section of spring elements 9 on top downwardly to the rest or lower section of each portion 7 and eventually to the underlying, support member or platform formed by the attached base portions 5.

Stated another way and referring again to FIG. 5, each spring member 3 has a main body or main pillar 15 atop which is positioned a plurality of smaller pillars 9. In this manner, each spring member 3 assumes the overall configuration of a graduated pillar or column (i.e., small pillars 9 graduating into one large pillar 15 or conversely, large pillar 15 graduating into smaller pillars 9). The bottom or base areas 5 of these pillars 15 are then attached to one another to create an underlying, support platform or level for the pad 1. The main body or main pillar 15 and the smaller pillars 9 of each spring member 3 as shown can be cut from the same piece of foam if desired.

This graduated pillar design offers not only a continuum of pillar sizes for micro and macro-confirmations but also a continuum of spring constants at different depths of immersion. That is and referring to FIG. 6, the graduated pillar design of the present invention not only can conform to small bony protrusions (e.g., the patient's elbow 17 in FIG. 6) but also can conform to and support larger, heavier parts of the patient's body (e.g., the buttocks 19 in FIG. 6). In doing so, the small pillars or spring elements 9 (because of their relatively small cross-sections as compared to the cross-section of the underlying, large pillar 15) have relatively low individual spring constants. Similarly, the smaller pillars 9 additionally have reduced surface-tension or hammocking effects. Consequently, these smaller pillars 9 on top of each main pillar 15 enable each overall spring member 3 to conform to small bony protrusions like the elbow 17 in a manner that favorably compares to more expensive products such as those using fluid bladders. This in turn results in less pressure being exerted on the patient's skin at such critical locations than if the smaller pillars were not present. Such micro-confirmation to a bony part of the patient's body is achieved while at the same time, macro-confirmation to larger, heavier parts of the patient's body such as his or her buttocks 19 can also be achieved as illustrated in FIG. 6.

Figure 6:
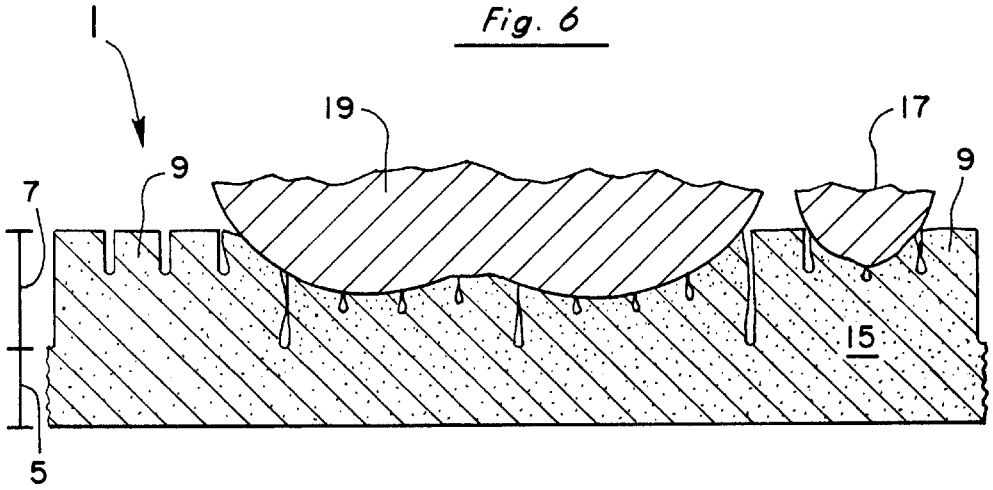
FIG. 6 illustrates the pad of the present invention in use supporting the buttocks and elbow regions of the patient's body.

In operation, the weight or force of the patient using the pad 1 in FIG. 6 is transferred from the small pillars 9 on top downwardly through the larger pillars 15 to the underlying support platform or level 5. These resilient areas of the pad 1 preferably have progressively larger spring constants. Consequently, they will work together to support the patient as these areas are progressively compressed in response to the force of the patient's weight on the pad 1. For small body parts, only the small pillars 9 may be initially compressed but as more weight is applied, the small pillars 9 and underlying main pillars 15 including the lower, support platform at 5 will progressively become compressed. In this manner, all parts of the patient's body will be properly supported by the pad 1 from the smaller ones like the patient's elbow in FIG. 6 to the larger, heavier ones like the patient's buttocks 19.

Figure 7:
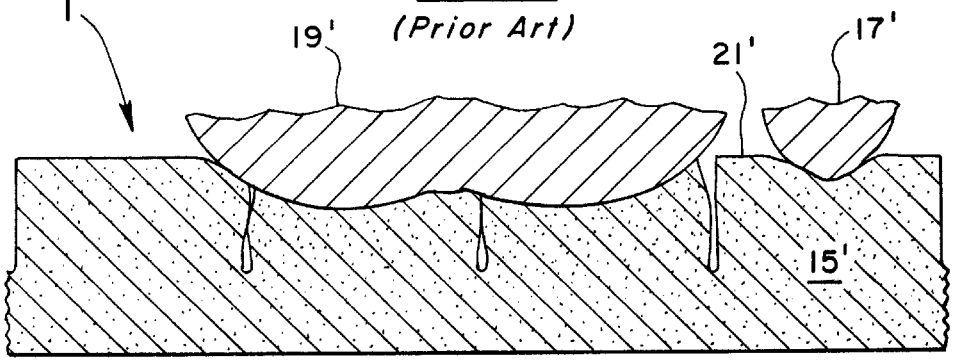
Fig. 7 (Prior Art)
FIGS. 7–9 illustrate prior art pads and their deficiencies.

In comparison to the pad 1 of FIG. 6 and referring to the prior art pad 1' of FIG. 7, if the main pillar 15' is not graduated as in the pad 1' of FIG. 7, the patient's elbow 17' will not immerse as far and will not achieve as high a degree of micro-confirmation. This is true because each large pillar 15' has a larger spring constant than the smaller pillars 9 of FIG. 6. Also, each larger pillar 15' has an increased surface-tension or hammocking effect due to the relatively large, continuous surface 21' of the pillar 15'. Using identical foams in FIGS. 6 and 7, the elbow 17' in FIG. 7 will be subjected to higher, vertically directed pressures and higher shear or horizontally directed forces. The higher, vertically directed pressures will more quickly occlude or block the blood flow and the higher shear or horizontally directed forces will pinch or distort small blood vessels and capillaries, also effectively occluding or blocking the blood flow. Both causes will lead to increased risk of developing decubitus ulcers.

Figure 8:
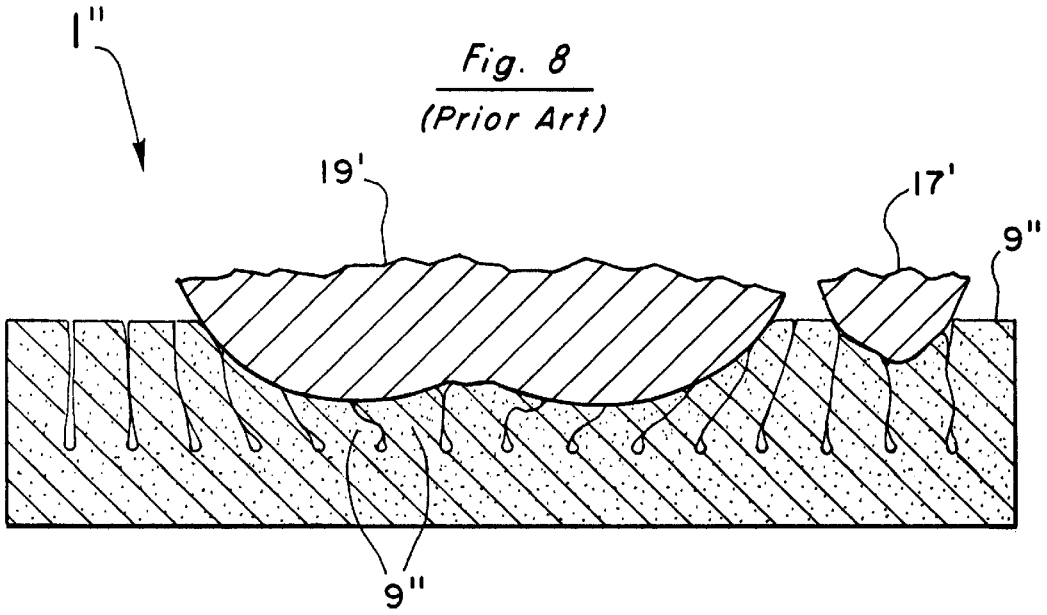
Fig. 8 (Prior Art)

Simply making a pad 1" as in FIG. 8 of small, tall pillars 9" (that are not graduated) may overcome the problem of FIG. 7 for the elbow 17' but not for the larger, heavier body parts such as the patient's buttocks 19'. Rather, the pillars 9" in FIG. 8 will tend to fold over and buckle instead of compressing vertically. This creates an uncontrolled pressure curve. It also causes the patient to sink into the pad 1" as the pillars 9" pile up or hang up on one another. The pillars 9" then behave like a solid piece of foam creating high pressures, poor confirmation, poor comfort, and shorter foam life. Reducing the pillar heights to make a pad 1'" as in FIG. 9 of just small, short pillars 9 is equally deficient. That is, the buttocks 19' will quickly compress and bottom out the short pillars 9 and make the pad 1'" act simply as a solid piece of foam with poor confirmation, high pressures, high shear forces, and hammocking.

Figure 9:
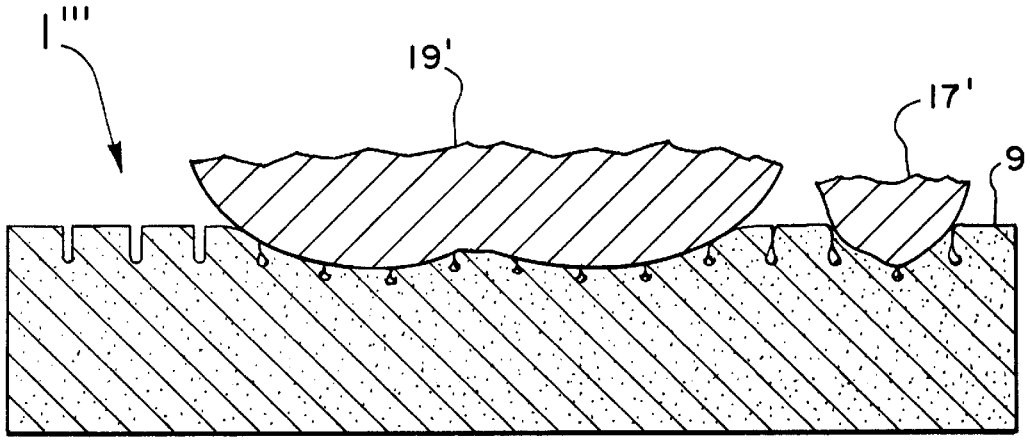
Fig. 9 (Prior Art)
Figure 11:
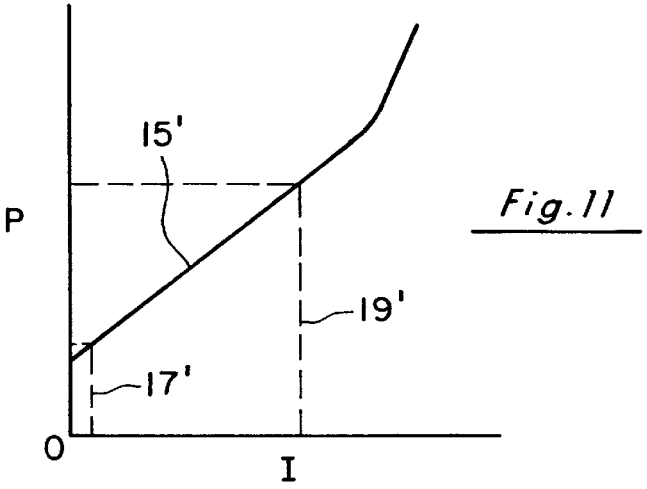
FIGS. 10–13 compare the general, operating characteristics of the pad designs of FIGS. 6–9 in a series of pressure versus immersion graphs.
Figure 13:
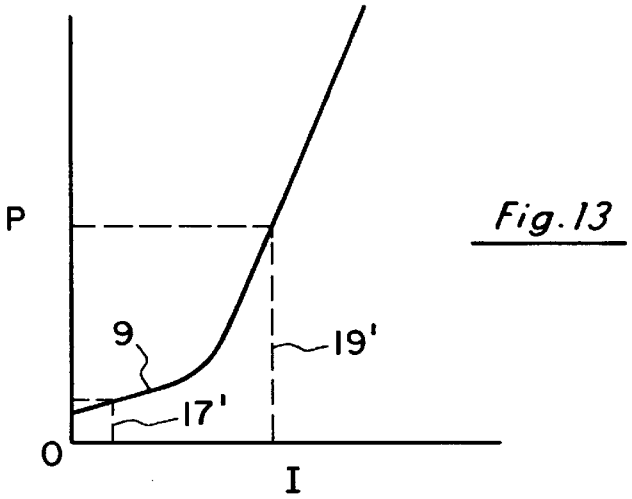
Figure 10:
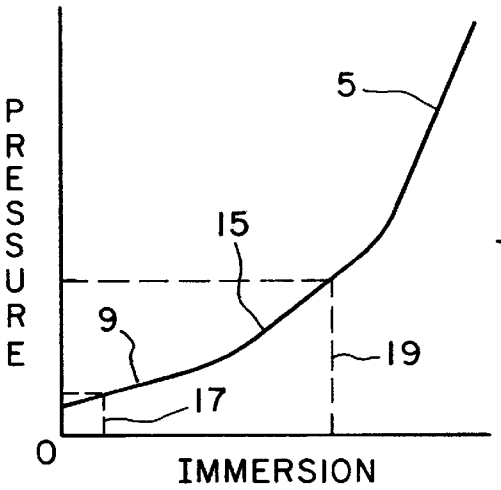
Figure 12:
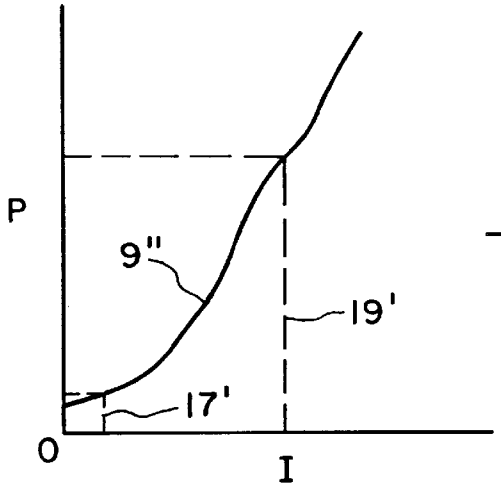

As illustrated in FIGS. 7–9, it is essentially impossible to provide optimum micro and macro-confirmations with only one pillar size. This is graphically illustrated in FIGS. 10–13. In these FIGS. 10–13, a comparison is presented of the general, operating characteristics of the pad 1 of the present invention of FIG. 6 with the prior art designs of FIGS. 7–9. This is done in a series of pressure versus immersion graphs (which characteristics essentially correspond to the force applied to the pads by the weight of the patient's body and the resulting deflection of the pads due to this applied force). For example and referring to the graph of FIG. 10 (which corresponds to the pad 1 of the present invention of FIG. 6), the pressure/immersion line has an initial portion 9. This portion 9 corresponds to the deflection of the small pillars 9 in supporting smaller portions of the patient's body such as the elbow 17 in FIG. 6. The second portion 15 represents the immersion of the larger, heavier parts of the patient's body such as the buttocks 19 in FIG. 6. The third section 5 in FIG. 10 indicates where the pressure and immersion relationship would be at very high deflections. This higher spring constant of the bottom support level 5 in FIG. 6 is an effective barrier to complete bottoming out, which tends to occur when a patient, for example, raises the head of the hospital bed, driving his or her ischial tuberosities down into the mattress pad. While the pressures are higher in such situations, they are far lower than if the patient were allowed to completely bottom out on the pad. In the preferred embodiments, the graduated pillar design of the present invention results in micro and macro-conformations that allow the pad 1 to adapt to a variety of patient sizes, weights, and positions. In this manner, all of the patient's body parts are properly supported in relatively low ranges not only for the larger, heavier areas such as the buttocks 19 in FIGS. 6 and 10 but also for the smaller bony protrusions such as the elbow 17.

In comparison, the prior art design in FIG. 7 of only large pillars 15' will, for the most part, properly support the patient's larger, heavier areas (e.g., buttocks 19') at pressures only slightly higher than those of the present invention of FIG. 6. However, this prior art pad 1' of FIGS. 7 and 11 will produce undesirably high pressures on the smaller, bony protrusions of the patient such as his or her elbow 17'. This is graphically illustrated by comparing FIGS. 10 and 11. Small but tall pillars such as 9" in the pad 1" of FIG. 8 compare favorably with the graduated pillar design of the present invention in supporting small parts of the patient's body such as the elbow 17'. However, this pad 1" of FIG. 8 produces undesirably high pressures on the patient's larger, heavier parts such as the buttocks 19' (compare FIGS. 10 and 12). Similarly, the pad 1'" of small pillars 9 in FIG. 9 will properly support an elbow 17' but not larger, heavier body parts such as the buttocks 19' (compare FIG. 10 and 13).

Referring again to the embodiment of the present invention illustrated in FIG. 5, the overall heights of the spring members 3 in FIG. 5 are typically about 4–8 inches separated by ⅜ inch slits 11. The base portions 5 (from the bottom of slit 11 down) are preferably about 2–3 inches or more thick (depending upon the application) with the top portions 7 on each side of the slits 11 being the remainder. The overall height of the top portions 7 is preferably at least two to four times the height of any of the individual pillars 9. The heights of the pillars 9 can vary (e.g., to give the cross section of the pad 1 a crown). However, they are preferably of substantially uniform height on each pillar 15 and about an inch or two high to provide the desired micro-conformation yet not easily buckle or fold over one another. To further reduce the tendency of the pillars 9 to buckle in use, they are preferably cubes (e.g., one to two inches on each side). There can be as many smaller pillars 9 as desired on each main pillar 15 but four to six separated by ¼ inch slits 11' have been found to be preferred. The number of pillars 9 to a large extent is simply limited by the foam cutting technology available to make the slits 11'. However, the slits 11' are preferably not so narrow that the pillars 9 will hang up on one another when depressed. The number of levels of graduated pillars 9 and 15 is illustrated as being two but could be three or more as desired. Preferably, the pillars would always be smallest at the top level or layer and increase in size with each level down. More levels would allow even smaller top pillars and therefore even better micro-confirmation. Regardless of the number of smaller pillars 9 atop each main pillar 15, the perimeter of the main pillar 15 (e.g., a square of four to eight inches on a side for a perimeter of sixteen to thirty-two inches) will always be substantially greater than the perimeter (e.g., a square of one to two inches on a side for a perimeter of four to eight inches) of any of the smaller pillars 9 on it.

Figure 14:
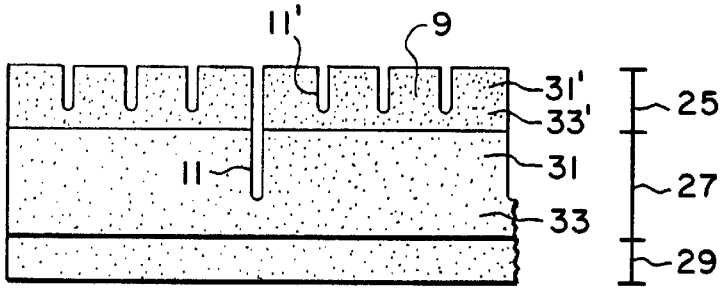
FIG. 14 shows a modified version of the pad design of the present invention.

The small pillars or spring elements 9 can be in any number of shapes including rectaloids (i.e., solids with rectangular sides including cubes) or convolutions. Additionally, as illustrated in FIG. 14, the small pillars 9 can be part of a separate layer 25 attached using adhesives or other methods to an underlying layer 27 of larger pillars. The pillared layer 27 could in turn be supported on a completely unpillared, bottom layer 29. In this manner, the layers 25, 27, and 29 could be made of different foams with different characteristics to better conform the pad to the needs of the patient. The layers 25 and 27 in this embodiment essentially duplicate each other in overall shape but just in different scales (i.e., the top and base portions 31 and 33 of the pillared layer 27 are substantially duplicated in shape by the upper and lower sections 31' and 33' of the top layer 25). In this regard and as discussed above, the underlying support platform or level (e.g., from the bottom of the slit 11 down in FIG. 14) is preferably thick enough (e.g., 2–3 inches or more depending upon the application) to properly accept or immerse the patient's body without bottoming out. This depth of the underlying support platform can be achieved using a single piece of foam cut to leave the desired thickness as in the pad 1 of FIG. 1. Alternately and preferably, this support can be achieved by providing a separate layer of foam like 29 in FIG. 14 which can be as thick or thin as needed. This separate layer 29 can then have its own characteristics to even further conform the pads to the needs of a particular application. The pad 1 of FIG. 5 could also be provided with an additional layer like 29 if desired or such additional support could be provided as needed by simply using the illustrated pad 1 of FIGS. 1–5 as an overlay atop a conventional mattress.

Figure 15:
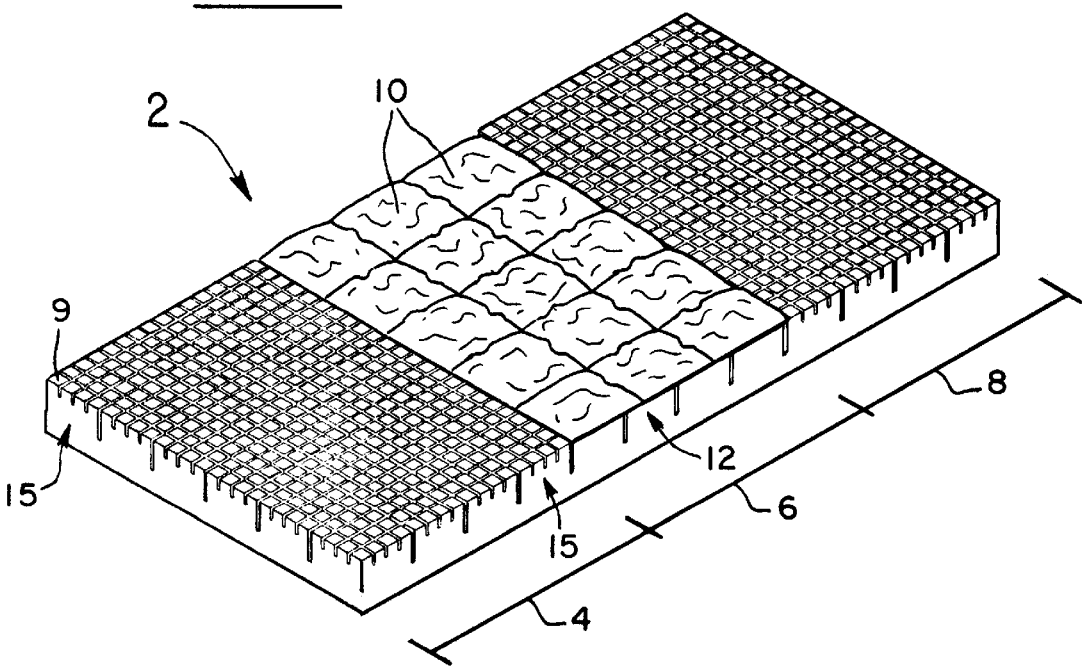
FIG. 15 illustrates another version of the pad design of the present invention in use in combination with a central section having a fluid bladder arrangement.

FIG. 15 illustrates another embodiment of the graduated pillar design of the present invention in use in conjunction with a fluid bladder arrangement. As discussed above, complete mattress pads with fluid bladder tops are very effective in reducing and preventing the development of decubitus ulcers. However, they are also very expensive. In this light, the graduated pillar concept of the present invention with its small, top pillars 9 was specifically developed to favorably compare to the more expensive fluid bladder pads. Consequently, and in a effort to create a product in between an all foam one like FIG. 1 and an all fluid bladder pad, the graduated pillar design of the present invention has been combined with a fluid bladder section to create the pad 2 of FIG. 15. This pad 2 as illustrated has head 4 and feet 8 sections of graduated pillars according to the present invention and a central section 6 of fluid bladders 10 atop pillars 12. The foam pillars 15 in sections 4 and 6 correspond to the foam pillars 12 in section 8 and the micro-conforming, small pillars 9 correlate to the micro-conforming fluid bladders 10. Such a combined product would be more expensive than a pad such as pad 1 in FIGS. 1–5 made completely of foam but less expensive than one made entirely of fluid bladders. It would also present a product desirable in the market to bridge the gap between lower-end, foam pads and the higher-end, fluid ones. As illustrated, the fluid bladder section 6 is the central one under the buttocks area (since this is where decubitus ulcers are generally the most severe) but it could be at the head and/or foot sections. There could also be more and smaller sections to better conform to the patient's specific needs with various, other arrangements of foam and fluid combinations.

The fluid bladders 10 as illustrated in FIG. 15 are preferably a plurality of separate, discrete pouches substantially filled with fluid and assembled and arranged to essentially form a continuous bladder layer. The fluid within the bladder pouches is preferably a viscous liquid such as a plastic or viscous thixotropic material. Such materials flow gradually when pressure is applied to them but maintain their shape and position in the absence of pressure. In most applications, the preferred fluid is an incompressible liquid with a viscosity greater than the viscosity of water (preferably several times greater) in addition to exhibiting the above-mentioned thixotropic properties. However, in some applications, the fluid could be air, water, or oil as well a waterbased or oil-based compounds if desired.

While several embodiments of the invention have been shown and described in detail, it is to be understood that various modifications and changes could be made to them without departing from the scope of the invention. For example, although the present invention is shown and described primarily as a mattress pad, it is equally adaptable for other application such as pillows as well as seat and back pads. Also, the various layers or levels of the pads of the present invention have been shown and described primarily as being made of foam as have the resilient columns or pillars. However, in many applications, the improvements of the present invention could be equally adapted for use with other resilient materials and designs including resilient columns or springs of pneumatic, liquid, or coil spring designs. The pads of the present invention have also been illustrated for clarity without any covering sheets or other bedding. In most cases, they may well have such protective coverings which would preferably be loose-fitting and oversized so as not to hammock and thereby degrade the operating characteristics of the pads as disclosed herein.

We claim:

1. A pad primarily intended to reduce the development of decubitus ulcers in a patient using the pad, said pad including:

at least two, upstanding, resilient, spring members (3), said spring members (3) being formed from a common, continuous piece of resilient, compressible foam and having base portions (5) and top portions (7), said base portions (5) being part of said common, continuous piece of foam and being integrally attached to one another, said top portions (7) being cut (11) in said common, continuous piece of foam and being separated and spaced (11) from one another, each of said top portions (7) having an upper section including a plurality of upstanding, resilient, spring elements (9) separated and spaced (11') from one another, each of said top portions (7) further including a lower section beneath said upper section of spring elements (9), said attached base portions (5) of said spring members (3) forming means for supporting the top portions (7) positioned thereon and the weight of the patient, said means for supporting being resilient and compressible wherein the weight of the patient is substantially transferred in a progressively compressing manner from said spring elements (9) of the upper section of each top portion (7) to the lower section of each top portion (7) and to said means for supporting in response to the force of the patient's weight on the pad.

2. The pad of claim 1 wherein the overall height of the top portions of each spring member is substantially greater than the height of any of the spring elements thereof.

3. The pad of claim 2 wherein said overall height of the top portion is at least twice as high as the height of any of the spring elements thereof.

4. The pad of claim 2 wherein said overall height of the top portion is at least four times as high as the height of any of the spring elements thereof.

5. The pad of claim 1 wherein the heights of the spring elements on each respective top portion are substantially the same.

6. The pad of claim 1 wherein the top portion of each spring member has a perimeter substantially greater than the perimeter of the upper section of any of the spring elements thereof.

7. The pad of claim 6 wherein the perimeter of the top portion is at least twice the perimeter of any of the spring elements thereof.

8. The pad of claim 6 wherein the perimeter of the top portion is at least four times the perimeter of any of the spring elements thereof.

9. The pad of claim 1 wherein the top portion of each spring member has a substantially rectangular perimeter.

10. The pad of claim 9 wherein the perimeter of the top portion is substantially square.

11. The pad of claim 1 wherein the spring elements are substantially in the shape of cubes.

12. The pad of claim 1 wherein the spring elements are upstanding pillars of foam.

13. The pad of claim 2 wherein the height of each spring element is about one to two inches.

14. The pad of claim 1 wherein the base portion (5) and lower section of each top portion (7) of each spring member (3) form a main body (15) and said spring elements (9) of each spring member (3) are positioned atop said main body (15).

15. The pad of claim 14 wherein the main body of each spring member has a spring constant greater than the spring constant of any of the spring elements thereof.

16. The pad of claim 15 wherein the spring constant of the main body is at least twice the spring constant of any of said spring elements thereon.

17. The pad of claim 15 wherein said attached base portions have a spring constant greater than the spring constant of the main bodies thereabove.

18. The pad of claim 14 wherein said main body has a substantially rectaloidal shape.

19. The pad of claim 18 wherein each of said spring elements has a substantially rectaloidal shape.

20. The pad of claim 19 wherein each spring element has a substantially cubic shape.

21. The pad of claim 14 wherein said main body of each spring member is substantially in the shape of a single, large pillar and each spring element is substantially in the shape of a single pillar substantially smaller than the pillar of said main body.

22. The pad of claim 1 wherein said pad is a full length mattress underlying the patient's entire body.

23. The pad of claim 1 wherein said spring members are part of one of at least two sections of a full length mattress underlying the patient's body, said sections being horizontally adjacent each 5 other and underlying different parts of the patient's body.

24. The pad of claim 23 wherein the other section includes at least one bladder filled with fluid overlying a resilient material.

25. The pad of claim 24 wherein said resilient material is foam.

26. The pad of claim 25 wherein said resilient material includes a plurality of upstanding pillars of foam.

* * * * *